US011295616B2

(12) United States Patent
Fabian

(10) Patent No.: US 11,295,616 B2
(45) Date of Patent: Apr. 5, 2022

(54) ON RED, STOP. SIMPLE SPEED AND STOP CONTROL

(71) Applicant: Jesse Forrest Fabian, Seattle, WA (US)

(72) Inventor: Jesse Forrest Fabian, Seattle, WA (US)

( * ) Notice: Subject to any disclaimer, the term of this patent is extended or adjusted under 35 U.S.C. 154(b) by 0 days.

(21) Appl. No.: 16/565,585

(22) Filed: Sep. 10, 2019

(65) Prior Publication Data

US 2021/0074153 A1 Mar. 11, 2021

Related U.S. Application Data

(60) Provisional application No. 62/729,986, filed on Sep. 11, 2018.

(51) Int. Cl.
*G08G 1/0967* (2006.01)
*G08G 1/095* (2006.01)
*G08G 1/04* (2006.01)

(52) U.S. Cl.
CPC ..... *G08G 1/096725* (2013.01); *G08G 1/04* (2013.01); *G08G 1/095* (2013.01)

(58) Field of Classification Search
CPC ..... G08G 1/096725; G08G 1/04; G08G 1/095
USPC ..... 340/907, 901–905, 539.1, 539.11
See application file for complete search history.

(56) References Cited

U.S. PATENT DOCUMENTS 7,020,147 B1 * 3/2006 Amadon ..... H04L 12/2854 343/712
2002/0102951 A1 * 8/2002 Nakano ..... H03D 7/00 455/118
2003/0174309 A1 * 9/2003 Dewey ..... G01J 1/4257 356/73.1
2007/0076210 A1 * 4/2007 Kiesel ..... G01J 9/0246 356/454
2014/0321862 A1 * 10/2014 Frohlich ..... H04B 10/70 398/154

* cited by examiner

*Primary Examiner* — Daryl C Pope

(57) ABSTRACT

A design is disclosed for a stop signal light emitter and receiver which together enable simple automatic stopping control within designated spaces for moving entities like vehicles, robots or drones, while the transmitted signal remains clearly visible to animals or people. The motivation is to provide a minimum design and standardized spatial signal for safe operation of vehicles and machines and movement of animals and people where a stop signal is linked to a local spatial area. The local spatial area of the signal emitter is linked via transmission from an emitter which is part of a signaling device (where the signaling device is a traffic light or brake light for example), to a receiver where there signal is detected by optical and or photoelectric circuitry.

2 Claims, 4 Drawing Sheets

External control signal.

A vehicle traveling though the stop signal.

External control signal.

PE sensor 1, stop signal sensor.

road

Machine which embodies *PE sensor 1*

ON RED, STOP. SIMPLE SPEED AND STOP CONTROL

CROSS-REFERENCE TO RELATED APPLICATIONS

The present application claims priority to the earlier filed provisional application having application No. 62/729,986 and hereby incorporates subject matter of the provisional application in its entirety.

BACKGROUND OF THE INVENTION

The present invention presents a design for the implementation of a system of machine- or vehicle-readable stoplights. The innovation of machine readable signal lights is necessary as vehicles become more automated. This eventuality of machine readable signaling in vehicular traffic makes a common signaling format, one which can be implemented as basic infrastructure throughout different regions important to develop.

With the continual global proliferation of vehicles, an increase in smaller personal electric vehicles, unmanned and arial vehicles, machines and robots, a simple and ubiquitous spatial signal that makes automating stop control available and promotes standardization is necessary. It is clear from past success in electric traffic signaling that an optical signal is sufficient to provide signaling to vehicle operators, and that existing equipment centers optical stop signal transmissions near 680 nm.

To date, the development of traffic infrastructure has not generally provided machine readable signaling from stoplights to private cars. However this type of signaling is certain to take a place of importance due to the increasing sensory and computational power of vehicles. In some regions and cities, proprietary machine readable vehicular signaling for stopping has been developed for specialized applications, but it remains useful for only a small section of vehicles due to its proprietary format.

Currently robots and vehicles navigate from closed source proprietary machine learning models and inaccessible data. This is proprietary methodology can be a barrier to decision making about public use of spaces. Currently, vehicles are aware of their location through GPS, cameras, scanners, and in concert with the driver's knowledge of an area. Many vehicles have high resolution sensors for parking. The integration of these sensors happens in the vehicle's computer systems, and ultimately is coordinated by the driver who then controls the vehicle. Position and velocity of vehicles are generally not precisely specified by the traffic infrastructure.

Vehicular transportation consumes up to several hours per day of the lives of people in developed countries. This statistic is becoming applicable for developing countries as well, as more complex transportation networks are developed. Making these several hours as safe as possible becomes important in the face of the real dangers that transportation presents [1].

Structuring traffic flows is accomplished significantly through visual signaling, primarily fixed and LED (light emitting diode) based signs. Dynamic structuring (time based, or otherwise controlled) of traffic flows is directed through the use of light-based traffic signals, the common red-green-yellow lights that drivers must obey. Vehicle operator observance of signals is unpredictable [2]. Current automated traffic infrastructure controls generally do not create a signal pathway to the vehicles themselves, or to the vehicle control system. Rather they link to the driver primarily through the driver's visual system. This is changing slowly as vehicles become more aware of their environment through cameras and other sensors.

Location awareness is paramount in traffic safety. The most critical moment for vehicle location awareness is the condition in which the vehicle must stop in a specific zone, for example at an intersection, or because another car is stopping ahead. Typically failure to stop in the specified zone is a violation of safety standards and could cause damage or destruction of the vehicle. The real implication of this is tragedy, which has become real for millions of drivers throughout the world, and increases with the growth of transport infrastructure.

Goal and Motivation of the Invention

A stop signal is obviously needed as drones continue to crash into airplanes and autonomous cars continue to have no hardened communications link to their environment. The simple implementation of a stop signal is important for safety.

Beginning from a safety critical application requires the most basic simplicity and reliability, and this is a basis on which other applications can be built. Autonomous vehicles and other mobile devices should move toward real-time spatial processing from public spatial signals on vehicles and in the environment. Public optical signals allow a public mobile and informational environment for vehicles, drones, robots and other possibly dangerous moving machines.

BRIEF SUMMARY OF THE INVENTION

The present invention called "On Red, Stop" is a protocol specification and transmitter-receiver system design for asking moving things to stop. For precision in description, hereafter the physical system will be referred to as "On Red".

The objective is a simple design for optical stop signaling while implementing spatial and directional signaling, velocity measuring capability and state signaling capability. The presented design allows state changes at at 50 Hz, limited by the speed of photon detection. The On Red design does not attempt to be a full featured system, but only a basic and easy to implement system. It is the purpose of this invention to convey the possibility of machine readable stop control to administrators of machine operation, vehicle traffic and factory production systems and devices, and individual people. The main function is to allow simple machine readable stop control to increase safety for moving machines, robots and drones that may have varying mobile parts and appendages, and which may move on or fly above a ground plane.

The intended scale and area of implementation of the transmitter and receiver devices is in traffic networks, in factories, laboratories, near machines, and in households. The receiver device is intended to be used on robots, machines, vehicles, and other moving objects which may need to have movement control, especially an emergency stop function. The transmitter device is intended to be used structurally as part of a system and in other implementations as a personal control device like a key, remote control, or from a smartphone or as a protective wearable transmitter in shoes, glasses, or clothing.

The present invention is based in a simple protocol of a red (near 680 nm) signal light meaning stop, which was developed for existing transportation systems linking traffic signals and vehicles. Using existing vehicle brake lights and running lights, capability for transmitting the protocol is already inherent in global vehicle production. It links traffic signals and existing central traffic control systems with vehicle control.

The On Red system implemented in stoplights and brake lights creates a data network along roads and between vehicles which carries traffic control information. It allows automatic and emergent speed control of vehicles and automatic avoidance of vehicle collisions even in older model vehicles.

The signal format proposed is technologically simple and selected to minimize the economic and technological burden of its implementation (for both transmitter and receiver) with a goal of maintaining an ability to be deployed ubiquitously through all forms of vehicle and device. At the same time, complex systems in advanced vehicles can use the signal to compliment their location control system and can also present more information (transmitted via their own brake lights) through modifications made to the basic signal structure.

The signal is not limited to vehicle transportation, and its stop function can be used to control robots, drones, factory equipment or other moving devices. It can be used to hold immobile robotic arms which are otherwise dangerous to humans. It can be used in emergencies to stop the motion of appliances, for example to stop a runaway lawn mower or a vacuum cleaner. It can be used to prohibit drones from entering an area as they must stop when their path intersects the signal. Stop signal transmitters can be used in children's clothing, baby strollers, and pet collars to prohibit vehicle impact.

The stop signal protocol used by the present invention is designed as one of the simplest possibilities for a machine readable stop signal which can maintain the existing, almost universal agreement, on the characteristics of human readable light based stop signals. In many countries and increasingly in traffic control systems, the stop signal is a light based human readable stop signal near 680 nm and with a constant output. By controlling the output with a square wave, the gated optical signal encodes local time. The stop signal transmission operates as a square wave at 100 Hz. By detecting the leading edge of the square wave a vehicle traveling though the signal receives a position update every 0.01 seconds, or each 33.3 cm when traveling at 120 Km per hour. At slower speeds this spatial resolution increases. It is trivial for a vehicle, a smart device, or a simple circuit with an optical sensor to detect this signal, and generate a stopping response.

DETAILED DESCRIPTION OF THE INVENTION

Figure 1:
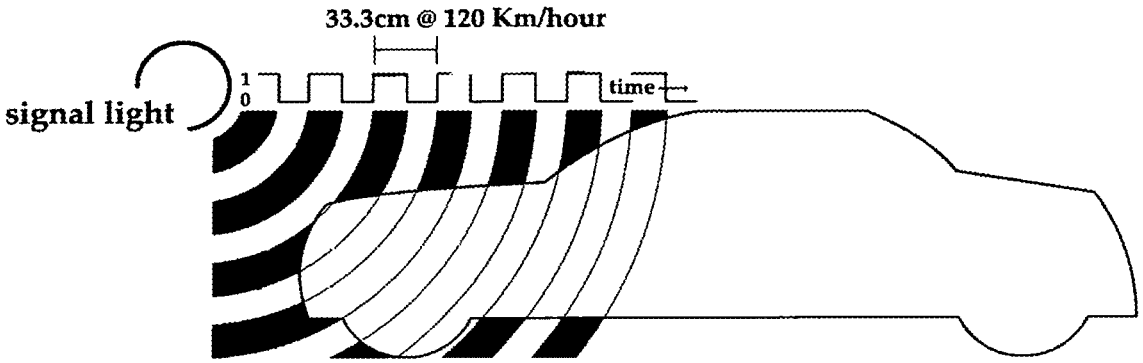
FIG. 1 shows the spatial relationship of a passenger vehicle traveling though the stop signal. The high and low periods of the signal are shown at their location in the space around the vehicle at a moment in time. The high period of the square wave allows a position update every 0.01 seconds and it extends over an area of 33.3 cm when the vehicle is traveling at 120 Km per hour.
Figure 2:
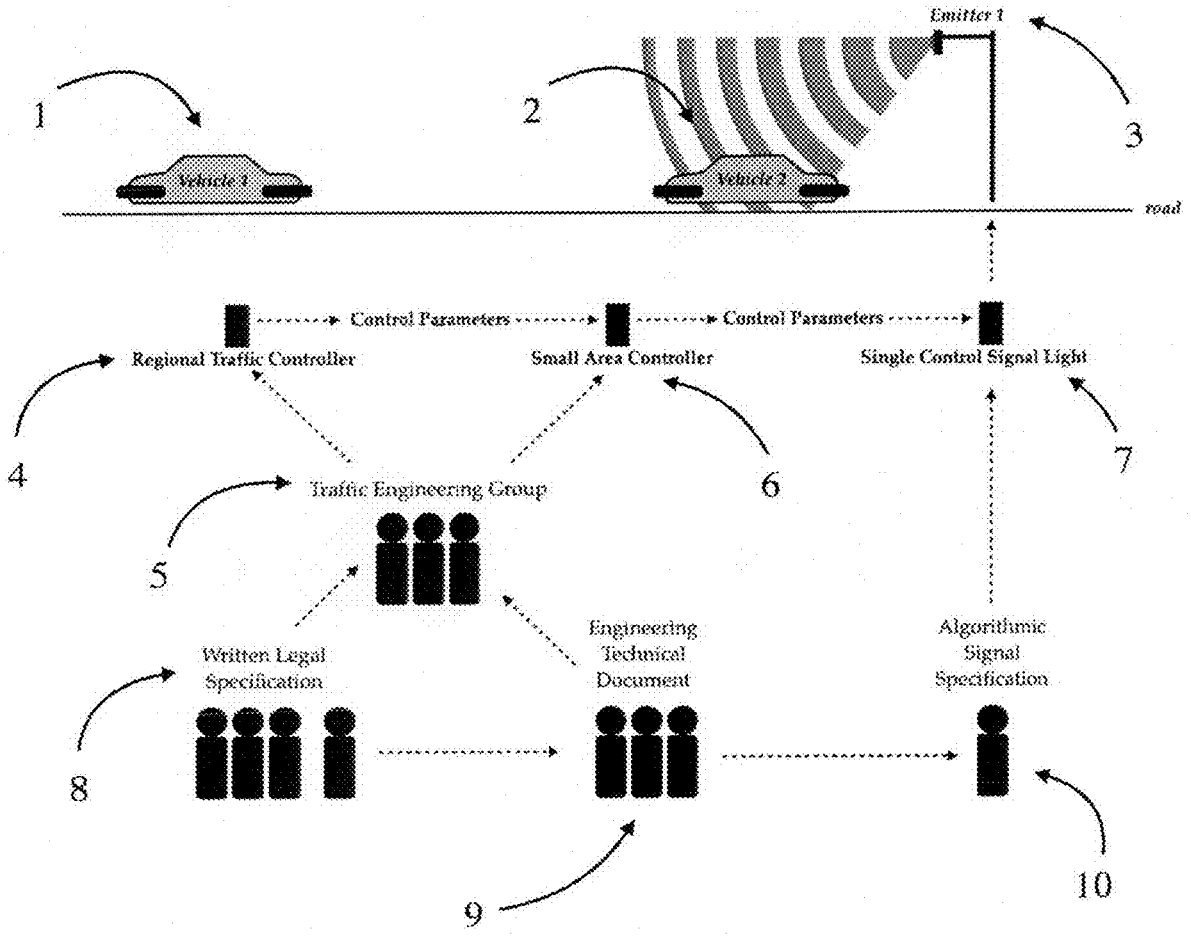
FIG. 2 shows the External Control Signal. The emitter (3) is shown in context of a roadway with vehicles (1,2). The localization of a vehicle within the emission range of the emitter is shown (2). A schematic of the communication of the control parameters which determine the activation and deactivation of the emitter (3) is shown. The communication path from human agency (5,8,9,10) through machine information processing (4,6,7) to the control of the output of the emitter (3) is shown.
Figure 3:
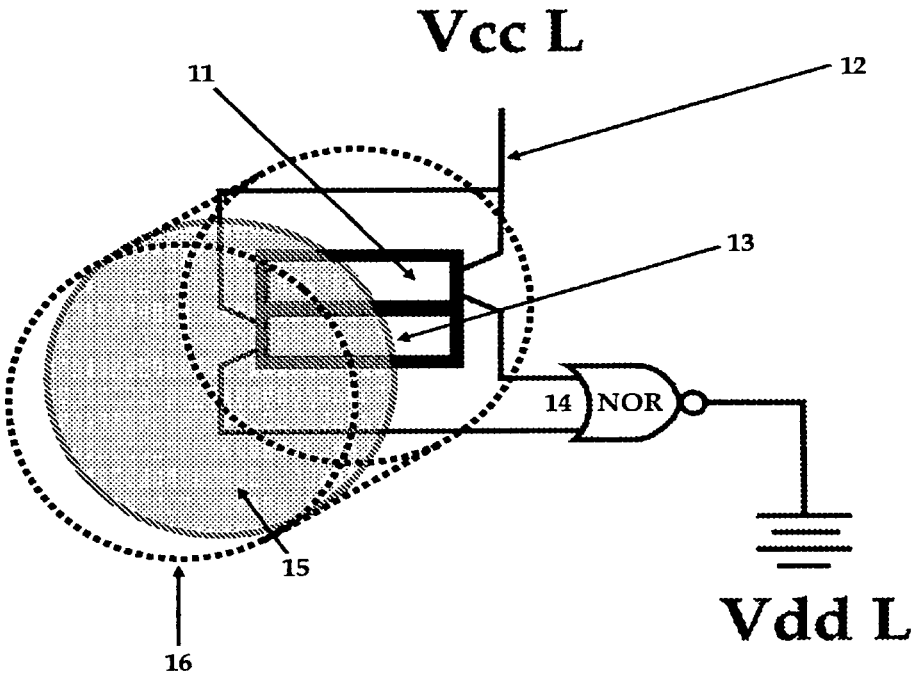
FIG. 3 shows the PE sensor 1, stop signal sensor. The arrangement of barrel, filters sensors and electrical circuit are shown in their construction arrangement The various elements are labeled: (11) 100 Hz square-wave frequency detector, which is connected by an (12) electrical circuit to an (14) input of a NOR gate; (13) a near W wavelength detector is connected to the other input of the NOR gate. A filter (15) which covers the square-wave frequency detector and the near W wavelength detector is placed at the input to a (16) barrel which is placed over the sensors, allowing light to reach the sensors at a limited angle.
Figure 4:
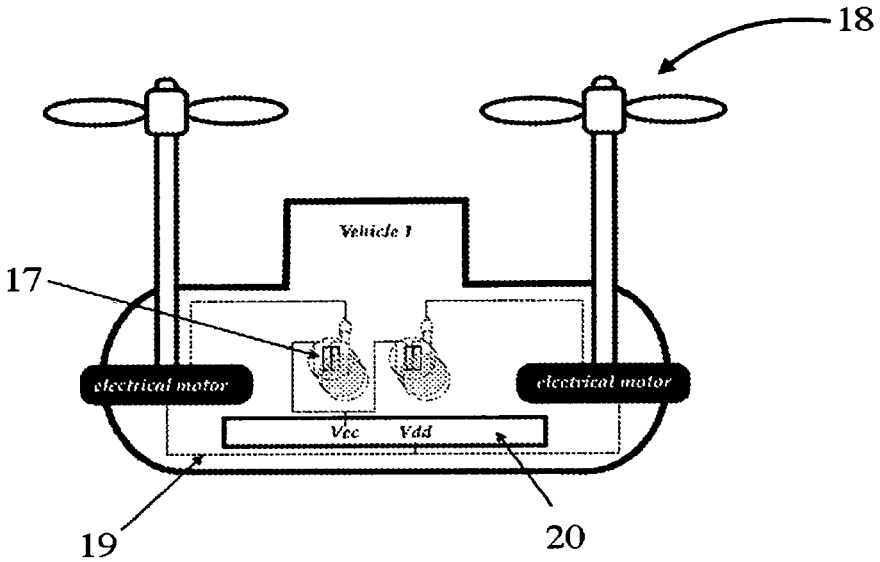
FIG. 4 shows a Machine which embodies PE sensor 1. The location of the stop signal sensor (17) is shown. A motion activity (18) of a propeller is shown. The circuit path (19) which powers electric motors, and (20) a battery are shown.

The present invention requires a square wave signal generator at the transmitter, and a 100 Hz frequency detector at the receiver. Such hardware modules integrate into the physical and signaling infrastructure of existing roadways and buildings, safety lighting, and into the brake signaling systems of vehicles, What is proposed is an open and basic signaling pattern, which can be used where cost and complexity is a factor, but is also useful to an advanced smart vehicle. The only significant feature of this format is its simplicity, so that it can be deployed at minimal cost. Because of its simplicity it has the potential of broad adoption if found to be a contributor to traffic safety, which is an ultimate goal of the system.

Considering the safety advantages of having the driver, the vehicle, and the traffic infrastructure act in concert to effect location control in critical areas like intersections, or when the vehicle ahead stops unexpectedly, a machine-readable stop signal system is needed. Such a system is herein proposed in the most basic format and architecture, so that the fundamental safety and technical considerations are satisfied, and so that it may be easily implemented. From such a simple basis it may then be adapted and develop complexity as needed to satisfy particular implementations. The On Red stop signal format standardization allows trivial machines from the size of nano-machines, to small tools like drills and saws, and larger to mobile robots and drones, up to trains, planes and automobiles, to identify the signal and its source by frequency and wavelength. The signal allows machines to determine if they are moving toward or away from the signal transmitter, and the rate, and to stop.

Existing intelligent traffic control systems and vehicles can become a road-long network as receivers detect stop signals and the stop request is reproduced by the braking indicator lights of cars near the transmitter. A smartphone app can operate to recognize the signal from the camera's video stream and provide an audible alert on detection of the On Red stop signal. Receivers in a vehicle control system can directly modify velocity via the car computer. The stop signal can be presented by a common mobile device like a keychain, shoes, a smart phone making it possible for a person in emergency to stop the motion of a drone, or a car, or a surgery robot.

From vehicles' vehicle brake lights and running lights a data network along roads and between vehicles which carries traffic control information can emerge: traffic control systems and vehicles become a road-long network as receivers detect stop signals and the stop request is reproduced by the braking indicator lights of cars near the transmitter.

Example Implementation, a Preferred Embodiment

Stop Signal Light Emitter

The stop signal light emitter is intended to integrate into to currently existing traffic signal lights so that implementation into currently existing traffic control networks may have minimal administrative and engineering barriers. From a traffic system administration perspective and from a vehicle operator perspective the presently described stop signal light emitter and previous art differs only in signal transmission characteristics and photon information characteristics. The information carrying characteristics of the signal can not generally be detected by people but can be easily detected by photoelectric circuits or optical devices.

A plurality of photons are transmitted by an emitter "Emitter 1" which operates to transmit a quantity of photons measured in Watts at wavelength W in the pattern of a 100 Hz square wave signal where the high part of the square wave is the emission of photons and the low part of the squad wave is the absence of photons. The 100 Hz square wave signal is defined to have equal time periods low and high within a cycle period. The transition from high to low is used as a timing feature in the signal and so must occur as fast as possible, being ideally described by a Heaviside function so that the wavefront of the photons is a sharp edge.

The quantity of emitted photons transmitted by emitter "Emitter 1" measured in Watts is determined by local law and traffic administration authorities in the jurisdiction of implementation of the transmitter. With contemporary current art, light emitting diode (LED) emitters or lasing emitters, signal transmitters can be implemented from milliwatts to hundreds or even thousands of watts as required by a local traffic signal installation site.

The signaling wavelength W that is transmitted from the signal emitter is locked at W nm so as to be invariable when measured at the emitter. The wavelength W of the transmitter must be selected on implementation to obey local traffic law in the jurisdiction of implementation. Traffic signals and brake lights in the USA are generally near 680 nm and so a wavelength W locked at 680 nm would be suitable for implementation of traffic light signals in the USA.

Directional transmission is accomplished from a radiation source that emits photons under a controlled divergence D. Divergence is a measurement, in units of angle or radians, of the ratio of the spread of light cone to distance traveled by photons. D is further categorized into two dimensions which can be described as vertical $D_\varphi$ which is perpendicular to the ground, and horizontal $D_\theta$ which is parallel to the ground. Divergence angle is set by traffic control officials according to the requirements of the local traffic signaling spatial area.

Setting the divergence is important for a stop signal as the divergence is a measure of the spatial area within which the signal can be received. For people this is the viewable angle of the light, for vehicles this determines the spatial area in which they are requested or required to stop. In current traffic signals control of light divergence is accomplished by positioning lenses in front of the light emitter and or masking the output of the light emitter with an opaque metal shell. Divergence can also be controlled by means of metamaterial lenses, lasing, or photon wave interference.

Stop Signal Light Sensor

Photons are received by a photoelectric sensor "PE sensor 1" which operates to count a quantity Q of photons of wavelength W plus or minus wavelength R, where R is the range of values calculated from (W−R) to (W+R) which we can write as ±R. This gives us a range of wavelengths W±R which are the wavelengths that the receiver is to detect, and we call these the "near W" wavelengths. The quantity Q of photons received per unit of time t can be understood as a two dimensional matrix of data on dimensions Q and t.

PE sensor 1 has the function to identify 100 Hz square wave signals in radiation of a wavelength near W and interpret this as a signal to stop a vehicle. The accuracy of PE sensor 1 in the time dimension and the photon quantity dimension should be at least 1 part in 1000 so that the sensor is capable of reliably detecting a 100 Hz square wave signal. Higher accuracy improves the speed and spatial accuracy of stopping control, simple detectors based on a photoelectric resistor-capacitor resonator may be appropriate for some applications like dog collars or toys, while sensor arrays capable of detecting single photons may be appropriate for other implementations like precise machine control.

A filter to block out photons which arrive from irrelevant incoming angles polarizations and wavelengths may cover PE sensor 1 as required for a particular implementation:

A. The determination of what incoming angles are acceptable and what are irrelevant is defined as a range of angles on φ, and a range of angles on θ where φ, θ are dimensions perpendicular and parallel respectively to a two dimensional sensor surface at the sensor; and angle 0=0 is parallel to the Earth's surface if the vehicle is in the stopped state. Acceptable angles of reception may vary widely between vehicle types because of the capabilities of vehicle motion. For example an automobile in operation is concerned with stop signals that arrive from a direction that is generally parallel to its motion vector ±10 degrees of arc on θ and ±75 degrees of arc on φ, whereas a drone or robot may be concerned with stop signals arriving from any direction including above or below the vehicle.

B. The range of relevant wavelengths should not vary more than a few percent of the W center signal wavelength as the wavelength shift from W should be only a very tiny fraction of the speed of light c. The received wavelength shift from the transmitted W bears speed information of the vehicle which may be recovered if the sensor implements this function. This function determines the precision that we must impose on the transmission and detection of W±R if we should like to determine vehicle speed from W. In high precision implementations for example aircraft landing, it may be desirable to determine vehicle speed from W, in which case the transmitter and receiver must perform at high precision. In other implementations, for example a receiver embedded in a dog collar, the limitations on receiver complexity may relax the requirements on a precisely detected W.

C. So that the system may test that a received photon is not a reflection it may reject photons outside of a specified range of acceptable polarizations.

The receiving sensor is reached by photons bearing polarization and frequency characteristics. The incoming photons are directed to two detectors, one which signals high when the received square-wave frequency characteristic is within specification; and one which signals high when the received wavelength characteristic is within specification. The output of these two detectors is logically combined in a NOR operation. The output of the NOR gate will then signal low (logical false or 0) when a stop signal has been received. For normal operation of a vehicle, the output of the NOR gate will be 1 or high; and a low signal or 0 should stop the vehicle.

The receiver may determine relative speed by timing the duration of the lead edge of the signal, or by measuring the degree of photon frequency shift (a blueshift for vehicles approaching the signal).

A receiver may determine a vehicle's distance from the transmitter by measuring the intensity of the received signal. This intensity is the quantity of photons received during the high phase of the square wave, compared to the the quantity of photons received during the low phase. This provides a momentary measurement of signal intensity which is proportional to the distance between the transmitter and the receiver.

The receiver samples photons over a surface area perpendicular to the transmitter, at the leading edge of the vehicle so at the low speeds attainable in Earth's atmosphere we can ignore length contraction of the vehicle on its motion vector.

REFERENCES

1. James Lenarda, Alexandro Badea-Romerob, Russell Dantonc, "Typical pedestrian accident scenarios for the development of autonomous emergency braking test protocols," Accident Analysis & Prevention 73, pp. 73-80 (2014).
2. Bryan E. Porter, Kelli J. England, "Predicting Red-Light Running Behavior: A Traffic Safety Study in Three Urban Settings," Journal of Safety Research, 31, Issue 1, pp. 1-8 (2000).

The invention claimed is:

1. A stop signal Emitter consisting essentially of:

an apparatus which obeys local traffic laws of a jurisdiction that the emitter is implemented to emit photons; the apparatus including a signal transmitter for transmitting photons of known polarization P and wavelength locked ±R to a wavelength W;

where W is defined by stop signal protocols in the jurisdiction;

the transmitter emits photons in a 100 hz period square wave;

the apparatus further including a radiation source that emits photons that are limited in divergence angle in vertical Dφ;

and horizontal Dθ dimensions.

2. A stop signal sensor consisting essentially of:

an apparatus which is attached to a machine that performs an activity;

which contains a photon detector pd1 configured to detect photons and to output a logical high, meaning true, when photons are received in a time based 100 Hz square wave signal;

which contains a photon detector pd2 configured to detect photons of a wavelength near W±R and to output a logical high, meaning true, when photons are received;

of polarization near $P \pm R_P$;

of incoming conic angle $A \pm R_A$;

which contains a NOR logic gate that performs a logical NOR operation on the output of photon detector pd1 and photon detector pd2;

which on receiving such a logical false signal from the output of the NOR gate;

command the attached machine to stop an activity.

* * * * *